US007775745B2

(12) United States Patent
Simmons et al.

(10) Patent No.: US 7,775,745 B2
(45) Date of Patent: Aug. 17, 2010

(54) ANCHORING SYSTEMS AND METHODS OF USE THEREOF

(75) Inventors: Walter Neal Simmons, Durham, NC (US); Walter John Simmons, Martinsburg, WV (US)

(73) Assignee: J-LOK Co., Pittsburgh, PA (US)

( * ) Notice: Subject to any disclaimer, the term of this patent is extended or adjusted under 35 U.S.C. 154(b) by 0 days.

(21) Appl. No.: 12/356,454

(22) Filed: Jan. 20, 2009

(65) Prior Publication Data

US 2010/0183379 A1 Jul. 22, 2010

(51) Int. Cl.
*E21D 20/02* (2006.01)

(52) U.S. Cl. ..... 405/259.6; 405/259.5

(58) Field of Classification Search ..... 405/259.6, 405/259.5, 259.1, 302.1, 302.2, 288
See application file for complete search history.

(56) References Cited

U.S. PATENT DOCUMENTS

| | | | | | |
|---|---|---|---|---|---|
| 3,324,663 | A | | 6/1967 | McLean | 61/36 |
| 3,474,898 | A | * | 10/1969 | Montgomery | 405/259.6 |
| 3,731,791 | A | | 5/1973 | Fourcade et al. | 206/47 A |
| 3,756,388 | A | * | 9/1973 | Murphy | 405/259.6 |
| 3,861,522 | A | | 1/1975 | Llewellyn et al. | 206/219 |
| 3,889,446 | A | | 6/1975 | Simmons et al. | 53/28 |
| 4,105,114 | A | * | 8/1978 | Knox et al. | 405/259.6 |
| 4,136,774 | A | * | 1/1979 | Ghoshal | 405/259.6 |
| 4,239,105 | A | | 12/1980 | Gilbert | 206/219 |
| 4,280,943 | A | | 7/1981 | Bivens et al. | 260/29.2 E |
| 4,372,708 | A | * | 2/1983 | Bower et al. | 405/259.6 |
| 4,402,633 | A | * | 9/1983 | Self | 405/259.6 |
| 4,616,050 | A | * | 10/1986 | Simmons et al. | 405/259.6 |
| 4,729,696 | A | * | 3/1988 | Goto et al. | 405/259.6 |
| 5,397,202 | A | * | 3/1995 | Shrader et al. | 405/259.6 |
| 5,544,981 | A | * | 8/1996 | Nishida et al. | 405/259.6 |
| 5,993,116 | A | * | 11/1999 | Paxton et al. | 405/259.6 |
| 7,411,010 | B2 | | 8/2008 | Kish et al. | 523/176 |
| 2007/0017832 | A1 | | 1/2007 | Simmons et al. | 206/219 |

OTHER PUBLICATIONS

ASTM Designation F 432—94, "Standard Specification for Roof and Rock Bolts and Accessories," 1995 Annual Book of ASTM Standards, vol. 15.08 Fasteners, ASTM, Philadelphia, PA, p. 184-197; standard published Oct. 1994.

Lokset® Resin Capsule TOOSPEEDIE, Minova Australia Pty Ltd, 2003, 4 pages.

Lokset® Resin Capsule J Series Resin, Minova Australia Pty Ltd, undated, 4 pages.

Lokset Resin Cartridges. Polyester resin anchoring system. Thiessen Team, undated, 2 pages.

Jaco J. van Vuuren and Mike Da Costa, "Improving Stope Support at Modikwa Platinum Mine," 23rd International Conference on Ground Control in Mining, Aug. 2004.

* cited by examiner

*Primary Examiner*—Frederick L Lagman
(74) *Attorney, Agent, or Firm*—The Webb Law Firm

(57) ABSTRACT

A method of adjusting gel time of a grouting system used for anchoring a reinforcement in a mine includes adding inhibitor to initiator of the grouting system, the inhibitor and initiator being disposed together in a first compartment of a multi-compartment shreddable package.

26 Claims, 4 Drawing Sheets

ANCHORING SYSTEMS AND METHODS OF USE THEREOF

FIELD OF THE INVENTION

The invention relates to anchoring systems and methods of use thereof. The invention further relates to resin systems for anchoring bolts and other supports in mines.

BACKGROUND OF THE INVENTION

Two-speed resin systems are well-known for anchoring mine bolts and tendons to provide roof and side wall support in mines. In particular, the resin systems are provided in capsules which are inserted into boreholes and subsequently punctured in a manner such that the contents are mixed and then allowed to solidify. The capsules may include two compartments. A first compartment may include both fast and slow speeds of a reinforced, thixotropic, polyester resin mastic (a fluid), while a second compartment may include an organic peroxide catalyst (also a fluid). The resin and catalyst are segregated from one another in the capsule so that reaction is prevented prior to puncturing of the compartments. Capsules housing a variety of ratios of fast to slow speed resins are commercially available, for example in ratios of 50% fast to 50% slow or 40% fast to 60% slow speeds. The use of two-speed resins permits bolt pre-tensioning. The "faster" speed mastic is disposed toward one end of the capsule while the "slower" speed resin is disposed toward the other end. As used herein, the term "mastic" means liquid component with filler. For example, there can be resin mastic (liquid component plus filler) as well as catalyst mastic (liquid component plus filler).

In order to puncture the capsule so that the contents of the compartments may be released and mixed, a bolt (or other reinforcing member) abutting a capsule for example may be rotated in place to shred the capsule, mix the components, and permit solidification of the mastic. The capsule is inserted into the borehole so that the "faster" end abuts the top of the hole thereby permitting a bolt inserted into the borehole to be anchored by the solidified mastic at the top of the hole first. The orientation of the capsule in the borehole ("faster" end inserted first) is important to the success of the anchoring medium to provide support. In particular, once the bolt has been anchored at the top of the borehole, a nut may be tightened at the opposite end of the bolt to apply a compressive force to an associated support plate abutting the mine roof surface to in turn compress the sagging mine roof. In order to successfully compress the region of the mine roof adjacent the bolt, the mastic should not anchor the bolt except at the top end of the borehole, until after the nut has been sufficiently applied. Only then should the "slower" speed resin disposed toward the other end of the bolt fully solidify to anchor the remaining portion of the bolt. In order to distinguish which end of a capsule contains the "higher" speed resin, a colorant may be added to one or more of the resins as an identifying feature. Such pigmenting or coloration thus can serve as indicia of gel time.

The resin capsules are available in a variety of lengths ranging from 2 feet to 6 feet and in diameter from ¾ inch to 1¼ inch.

Typically, in the United States, resins for mine roof supports are purchased in a pre-inhibited or pre-promoted condition. For example, the base resin typically may have a 20 minutes gel time, which may be adjusted through the addition of inhibitors and promoters. In other words, the polyester resins are purchased with a desired gel time which optionally may be adjusted using inhibiters and promoters to slow down or speed up, respectively, the gel time. The gel time of the resin is known as the time for the resin to set up, e.g., typically from 10 seconds to 2 minutes and in the United States, typically either 10 seconds, 30 seconds, 60 seconds, or 120 seconds. More particularly, as explained in U.S. Pat. No. 4,280,943 to Bivens et at entitled "Organic Grouting Composition for Anchoring a Bolt in a Hole," the entire content of which is incorporated herein by reference thereto, the gel time of a resin formulation as used herein is defined as the time that elapses between the mixing of the reactive components and the hardening or stiffening of the resin in the mixture (e.g., the mixture of resin and initiator/catalyst). The gel time is shorter at higher temperatures and/or with higher promoter content, and vice versa. Gel time testing will be discussed separately herein.

As used herein, the cure time of a resin formulation, as explained in U.S. Pat. No. 4,280,943, is the time required for the composition to achieve full strength, or a high percentage of its final strength, with a desirable goal being that the composition attain about 80% of its final strength in an hour or less. It is known that it is especially important that as strong as possible an interfacial bond be achieved between the resin and the wall of the hole, and the resin and the reinforcing member, during the curing period. In particular, the advantageous keying effect achieved by shifting of rock strata relative to one another usually is not available during this period because the roof has only recently been exposed.

ASTM Designation F 432-94 entitled "Standard Specification for Roof and Rock Bolts and Accessories" provides a Speed Index for chemical grouting materials which "indicates the time in seconds from completion of mixing until an anchorage level of 4000 lb is achieved when tested" in accordance with the laboratory test specified in the Standard. According to the Standard, grout formulations are identified in accordance with the speed index classification system in Table I below, where the Maximum Cure Time is to achieve a 4000-lb test load:

TABLE I

| Speed Index | Maximum Cure Time (s) |
|---|---|
| 15 | 15 |
| 30 | 30 |
| 60 | 60 |
| 240 | 240 |
| 600 | 600 |
| 1000 | >600 |

Despite the availability of a standard and its associated testing regime for determining Maximum Cure Time, however, the testing regime is fairly rigorous and thus time consuming and not easy to precisely follow, and concomitantly can be costly. Moreover, while the ASTM standard for example might indicate that a particular grout formulation meets a Speed Index of 15 which correlates to a Maximum Cure Time of 15 seconds, this information does not reveal the progress of a grout formulation toward solidification over a shorter period of time. In other words, while a particular formulation may be determined to meet a Speed Index of 15, the formulation may reach a gel state substantially faster than 15 seconds and this may be undesirable in a given application. As an example, it may be desired for a bolt to "set up" within 15 seconds, but not much faster than 15 seconds. Once the bolt grouting "gels," the bolt can't readily be maneuvered in the borehole because of the substantial viscosity of the grouting.

As used herein, the terms "grouting," "grouting system," "grout," and "grout system" mean a substance that hardens to anchor a reinforcing member in a space. For example, grouting can be provided in the form of a cartridge with a compartment housing a polyester resin and a compartment housing an initiator/catalyst, such that when the cartridge is shredded and the resin is mixed with the initiator/catalyst, a reinforcing member can be anchored in a space.

Both the Speed Index under the ASTM standard and gel time remain important, however. This is because even though a grout may have gelled, the grout may not have cured to the point that it can support a 4000-lb test load as required under the ASTM standard for purposes of safety.

In the United States, for example, the current practice is to purchase polyester resin from a manufacturer in a pre-promoted state. The acquired resin has a specific gel time, which subsequent to purchase may be adjusted by the purchaser using promoters or inhibitors to speed up or slow down the gel time to meet desired needs. For example, a formulation designated Speed Index 240 would have a Maximum Cure Time of 240 seconds, but the purchaser can add a promoter to the formulation to change the Speed Index to 180 which corresponds to a Maximum Cure Time of 180 seconds. Such Speed Index adjustment (which generally correlates with gel time adjustment) using a promoter thus is done in a batch-wise fashion, requiring an entire batch of resin to be consumed before making an additional gel time change (this is because a formulation can't be repeatedly promoted, then inhibited, then again promoted, etc., with the expectation that the addition of substantial additions of inhibitor won't effect the formulation's ability to cure or that the gel time can be increased at any point as desired). Additionally, gel time is dependent on the resin to catalyst ratio. According to this approach, if there is more catalyst the gel time is faster, and conversely if there is less catalyst the gel time is slower.

In a manufacturing operation, for example, resin initially may be supplied by a resin supplier with a gel time of 10 seconds. However, the manufacturer may desire to have 500 gallon capacity tanks of resin at gel times of 10 seconds, 30 seconds, and 60 seconds. Thus, 500 gallons of the 10 second resin may be pumped into a tank and mixed with inhibitor or promoter to make a batch of 30 second resin. Typically, once the 500 gallons of 30 second resin has been made, however, cartridges are formed until that batch has completely been consumed.

Nonetheless, it would be unusual for a purchaser to acquire resin associated with a gel time of 10 seconds, for example, and then batch-wise add inhibitor to modify the gel time associated with that resin to 60 seconds. This is because resin already is available in the United States as a standard product offering for a gel time of 60 seconds. Also, it is unusual to use inhibitor to adjust gel time, in general, because polyester resin for example is typically manufactured with a standard gel time on the order of 20 minutes; subsequently, promoter, which is costly, is added to the resin to make it faster. It then doesn't make sense to spend even more money to subsequently make the resin slower by adding inhibitor. By analogy, like use of an automobile's accelerator and brakes, it doesn't make any sense to "floor it" with the accelerator (make the resin much faster by adding promoter) and then adjusting the speed only using the brakes (make the resin slower by adding inhibitor). This compares with a "normal" method of driving an automobile in which speed increases are made by incremental increases in use of the accelerator pedal; normally, with resins, the speed is incrementally adjusted by adding promoter.

It is common to start with resin that has a 20 minute gel time, and then promote the resin to have a gel time of 60 seconds.

It also is common to have resin with a gel time of 10 seconds and inhibit the resin to a gel time of 20 seconds, or to have resin with a gel time of 30 seconds and inhibit the resin to a gel time of 45 seconds. But with respect to the former, for example, even with a gel time of 20 seconds, the resin would have a Speed Index of 30 seconds, meaning that a mine operator could not put load on a bolt potted with the resin for a full 30 seconds rather than 20 seconds.

To adjust gel time for mine roof support grouting systems, therefore, it is known to inject promoter into the resin. It also is known to separately manufacture two different batches of resins with each batch having a different gel time and separately pumping each of the two resins into a film cartridge so as to obtain a two-speed grouting system cartridge. In order to differentiate which end represents a particular resin speed, a dye is often included with at least one of the resins, but unfortunately the resin is somewhat dark in color and thus the addition of the dye can be difficult to discern. Using colorant in the resin requires significantly more colorant than using it in the inhibitor. This is because the resin is darker and more colorant therefore is needed to make a significant difference visually because the contrast change is small. Also, in a two resin cartridge, for example, seventy percent of the volume of the cartridge can be associated with the resin while 30% can be associated with the catalyst. Thus, in comparison, over twice the amount of colorant can be required because when coloring resin because there is over twice the amount of resin as compared to catalyst.

The primary roof support systems used in coal mines include headed rebar bolts typically 4 feet to 6 feet in length, ¾ inch and ⅝ inch in diameter, and used in conjunction with resin grouting in 1 inch diameter holes.

Typically, grouting is accomplished using multi-compartment resin cartridges. A variety of such cartridges are known disclosed in U.S. Pat. No. 3,861,522 to Llewellyn, U.S. Pat. No. 4,239,105 to Gilbert, and U.S. Patent Application Publication No. US 2007/0017832 A1 to Simmons et al. As discussed above, the multi-compartment cartridges are designed to keep the polymerizable resin and catalyst separate from each other until the cartridge, when inserted in a borehole, is intentionally ruptured by a mine roof bolt that also is inserted in the borehole. When the resin and catalyst are mixed (by virtue of rupture as well as spinning of the bolt in the borehole) and subsequently harden, the bolt is held in place.

In some prior art devices and methods for forming partitioned film packages such as multi-component resin cartridges, a series of cartridges are formed and then cut at a clipping head associated with the package-forming apparatus or in a separate operation from the cartridge forming operation, i.e., off-line using a cutter separate from the clipping head. In particular, the cartridges are separated from one another proximate their clipped ends, i.e., proximate the regions of the opposite ends of the cartridges which are each clipped so as to retain the resin and catalyst in the package. Thus, before being separated, adjacent cartridges have two clips adjacent each other with some cartridge packaging disposed therebetween. A cut is made between the adjacent clips to separate the cartridges.

SUMMARY OF THE INVENTION

An exemplary method of adjusting gel time of a grouting system used for anchoring a reinforcement in a mine includes: adding inhibitor to initiator of the grouting system, the inhibitor and initiator being disposed together in a first compartment of a multi-compartment shreddable package. The initiator may be catalyst mastic. The initiator may be a free radical generating component such as benzoyl peroxide. The inhibitor may be a free radical inhibitor which may be selected from the group consisting of naphthoquinone and hydroquinone. The grouting system may further include resin mastic in a second compartment of the multi-compartment shreddable package. The resin mastic may be polyester with a styrene monomer cross-linking agent.

An exemplary method of adjusting gel time of a resin-catalyst system used for anchoring a reinforcement in a mine includes: adding inhibitor to catalyst separated from resin in the system.

An exemplary method of anchoring a reinforcement in a mine includes: providing a borehole; inserting a capsule in the borehole, the capsule having (1) a first section with resin mastic therein and (2) a second section with catalyst mastic and an inhibitor therein, wherein the inhibitor is substantially disposed in only a portion of the catalyst mastic in the second section; inserting a reinforcement in the borehole; spinning the reinforcement to puncture the capsule and mix the resin mastic, catalyst mastic, and inhibitor; holding the reinforcement stationary for a first period of time. The capsule may be inserted in the borehole so that an end of the capsule abuts a closed end of the borehole. Also, the capsule and reinforcement may be inserted into the borehole at the same time. The method may further include: tensioning the reinforcement after the first period of time.

An exemplary grouting system for anchoring a reinforcement in a mine may include a package that is a tubular member formed of polymer film and having discrete first and second compartments, a resin mastic disposed in the first compartment, and a catalyst mastic and an inhibitor disposed in the second compartment. The catalyst mastic may be benzoyl peroxide, and the inhibitor may be naphthoquinone. The grouting system may further include a colorant in the first compartment, and the colorant may be a dye. The resin mastic may be polyester with a styrene monomer cross-linking agent. The resin mastic may be methyl methacrylate. The second compartment may have a first portion in which both catalyst mastic and inhibitor are disposed and a second portion in which catalyst mastic is disposed substantially without inhibitor. At least one of the catalyst mastic and resin mastic may include limestone.

An exemplary method of achieving substantially uniform setting of a resin-catalyst system used for anchoring a reinforcement in a mine includes: adding inhibitor to an initiator in the resin-catalyst system such that gel time of the system is independent of resin to catalyst ratio, wherein the resin to catalyst ratio is from about 1:1 to about 9:1. In some embodiments, the resin to catalyst ratio is from about 1.5:1 to about 4:1. The catalyst may be benzoyl peroxide, and the inhibitor may be naphthoquinone.

BRIEF DESCRIPTION OF THE DRAWINGS

Preferred features of the present invention are disclosed in the accompanying drawings, wherein.

DETAILED DESCRIPTION OF THE PREFERRED EMBODIMENTS

Figure 1:
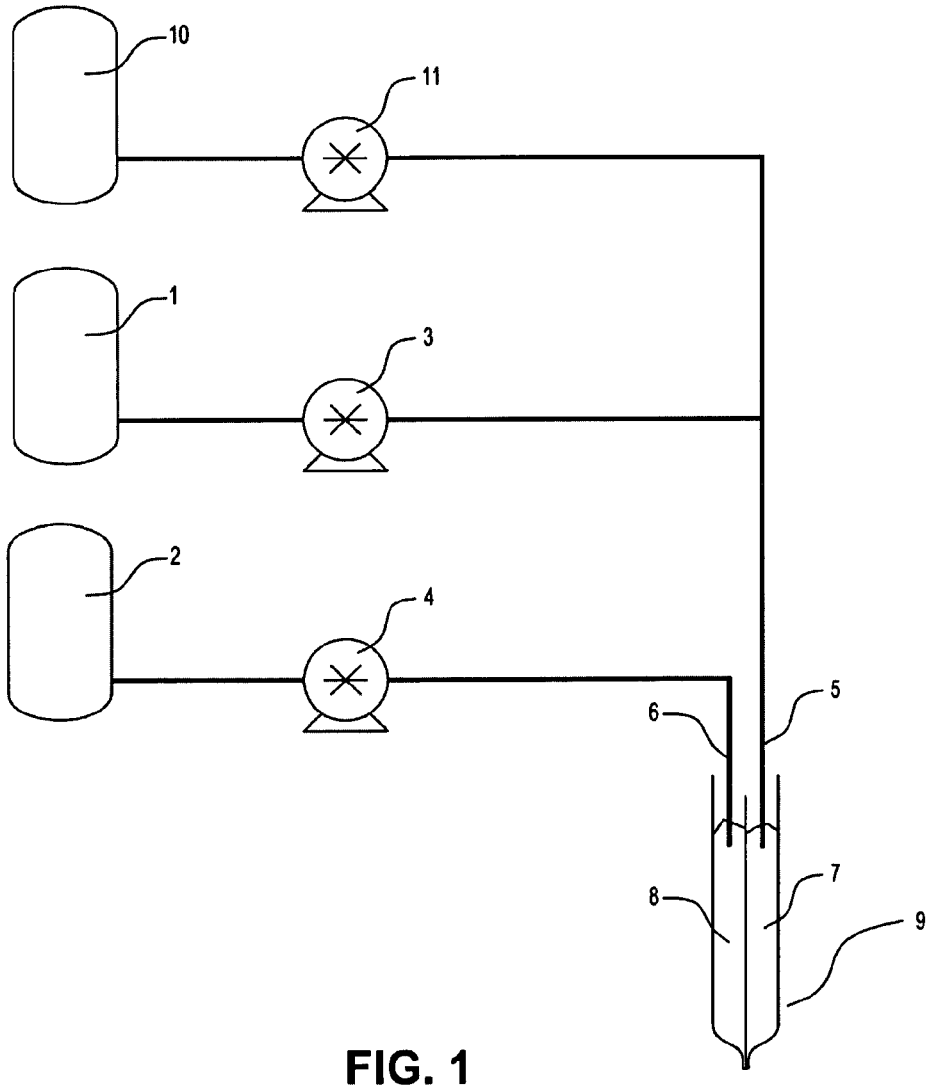
FIG. 1 shows an exemplary embodiment of a cartridge manufacturing operation.

It is typical to modify gel time by using promoters or inhibitors in the resin mastic used in the two speed polyester resin systems for mine roof supports. Both promoter and inhibitor can be added to the resin to adjust gel time. However, advantageously and unexpectedly, it has been discovered that inhibitor can be added to the catalyst in such systems, not only without adversely effecting performance but with potential beneficial consequences. In particular, both the resin mastic and catalyst used in the two speed resin system typically are provided with filler. It is known that catalysts, such as benzoyl peroxide (BPO) with either a water or oil base, are unstable when used with certain fillers such as limestone. Specifically, if the limestone filler is not of high purity, the BPO can degrade. While it is not known for certain why this degradation occurs, it is believed to be related to the presence of iron impurity in the limestone. Yet, it has unexpectedly been discovered that adding inhibitor such as naphthoquinone (NQ) to the BPO catalyst with limestone filler slows and/or largely prevents the degradation as compared to that noted for catalyst without added inhibitor. In general, it has previously been thought that gel time modification for two speed polyester resin systems for mine roof supports should not be undertaken by modifying the catalyst, due to its instability, and it has been known that the instability of the catalyst can be exacerbated through the addition of promoters. Yet, it has unexpectedly been discovered that inhibitor can be added to either the resin or the catalyst in such systems to adjust gel time, with the addition in catalyst having limestone filler actually improving the stability of the catalyst. Because the resin and catalyst eventually are mixed when the capsule in which they are housed is shredded during installation of a mine roof support, it has been discovered, advantageously, that inhibitor thus could be included in either the resin or catalyst. Such modification of the resin and/or catalyst formulation by addition of the inhibitor thereto can be done at the manufacturing operation in a continuous operation or alternatively can be done batch-wise.

Because inhibitor can be added continuously to adjust gel time "in situ," immediate gel time modifications can be made while it also is possible to make a single cartridge with two different gel times. Such a two-speed grouting cartridge is particularly useful for torque tensioned bolt systems.

It also is not typical for catalyst manufacturers to add inhibitor to the catalyst because it is desired for the catalyst to be fast-acting. For example, it is typically assumed by catalyst manufacturers that BPO should break-down and catalyze a reaction as fast as possible. Thus, standard practice teaches away from adding inhibitor to catalyst. Yet, the present invention advantageously does add inhibitor to catalyst.

Another advantage of adding inhibitor to the catalyst instead of the resin in the grouting systems used for mine roof supports relates to the significant differences in the viscosities of the resin and catalyst. At a given shear rate of measurement, the viscosity of the resin used in such grouting systems is substantially greater than the viscosity of the catalyst, i.e. the resin generally is much thicker than the catalyst. When a grouting system cartridge is punctured by a reinforcement member in a borehole, the catalyst preferentially disperses toward the bottom of the borehole because it is thinner than the resin, resulting in less catalyst at the top of the borehole where initial solidification and anchoring are needed (i.e., a grouting system that is catalyst poor at the top of the borehole and catalyst rich at the bottom of the borehole). For example, a grouting formulation might start as 70% resin and 30% catalyst. Due to the differences in viscosities and preferential distribution ("squirt") of catalyst toward the bottom of the borehole proximate the torque-tensioning side where a nut for example is applied to the mine bolt, the formulation at the top of the hole might have 80% resin and 20% catalyst while the formulation at the bottom of the hole might have 60% resin and 40% catalyst. As a result, the grout at the top of the borehole might gel slowly while the grout at the bottom of the hole might gel quickly, and this is the opposite of the desired behavior in torque tensioned support systems. Thus, the inhomogeneous distribution of resin and catalyst from top to bottom, as described above, is undesirable.

By adding inhibitor to the catalyst, however, the preferential distribution of catalyst toward the bottom can be "balanced" by the increased amount of inhibiting that occurs in that region (where there would be more catalyst, there would be more inhibitor) so that a generally uniform gel time can be provided throughout the length of the cartridge. In some applications, it is desirable for the bolt to set uniformly over its length. Thus, a small amount of inhibitor can be added to a batch of catalyst so the resin to catalyst ratio advantageously doesn't matter with respect to the gel time, i.e. the gel time is independent of the amount of resin and amount of catalyst in a cartridge.

In other words, a small amount of inhibitor added to the catalyst allows for gel time to be nearly independent of the ratio of resin to catalyst typically found in mine roof support grouting systems. The addition of catalyst increases the speed of the reaction but the increased amount of inhibitor with the catalyst slows the reaction. When these two factors are balanced, the reaction speed becomes independent of the ratio of catalyst to resin.

Typically, a 70 to 30 ratio of resin to catalyst is used in mine roof support grouting systems. Other exemplary ratios of resin to catalyst in such systems include, for example, 85:15, 75:25, and 65:35.

Potential resins for use with the systems as described herein include, but are not limited to, polyester with a styrene monomer cross-linking agent as well as acrylates and acrylic resins and combinations thereof, unsaturated polyester resins dissolved in a suitable ethylenically unsaturated monomer or mixture of monomers such as styrene, alpha methyl styrene, vinyl toluene, and methyl methacrylate. Potential resins are provided in U.S. Pat. Nos. 3,731,791 to Fourcade et al. entitled "Securing of Fixing Elements Such as Anchor Bolts" and 7,411,010 B2 to Kish et al. entitled "Composition for Anchoring a Material in or to Concrete or Masonry," the entire contents of which are incorporated herein by reference thereto.

Potential catalysts for use with the systems as described herein include, but are not limited to, peroxide types such as benzoyl peroxide (BPO) with a water or oil base. Other such initiators include cyclohexane peroxide, hydroxy heptyl peroxide, 1-hydroxy cyclohexyl hydroperoxide-1, t-butyl hydroperoxide, 2,4-dichlorobenzoyl peroxide and the like, methyl ethyl ketone peroxide as well as inorganic peroxides alone or mixed with organic peroxides, such as sodium percarbonate, calcium peroxide, sodium peroxide. Potential initiators are listed in U.S. Pat. No. 3,324,663 to McLean entitled "Rock Bolting," the entire content of which is incorporated herein by reference thereto. As used herein, the terms "catalyst" and "initiator" mean a substance that initiates polymerization and optionally is consumed during polymerization.

Potential inhibitors for use with the systems as described herein include, but are not limited to, naphthoquinone (NQ) as well as hydroquinone, monoalkyl phenols, including monotertiary butyl phenol, monotertiary butyl hydroquinone, ortho-, meta- and para-cresol, higher alkyl phenols, polyhydricphenols, including catechol, resorcinol, and the partially alkylated polyhydric phenols, including eugenol, guaiacol, and mixtures of these, as listed in U.S. Pat. No. 3,324,663 to McLean entitled "Rock Bolting," as incorporated herein by reference above. Other free radical inhibitors also can be used. As used herein, the term "inhibitor" means a substance that decreases the rate of polymerization.

In one experiment, the inhibitor napthoquinone (NQ) was added to 1 kg of catalyst which had 2 wt % active benzoyl peroxide and 1.6 wt % benzoyl peroxide carrier, 80 wt % limestone, 16.1 wt % water, and 0.3 wt % thickener (hydroxyethyl cellulose). To the catalyst/inhibitor mixture was added a resin component which had approximately 15 wt % polyester unsaturated resin (commercial grade Polylite polyester resin from Reichhold Inc.) and 85 wt % limestone filler.

In the testing, five samples of the resin component were weighed as 13 gram portions into plastic cups. The cups were placed in a constant temperature water bath at 25° C. for 1 hour. A sample of each catalyst/inhibitor mixture containing one of the mixtures from Table II below, was weighed as a 7 gram portion into a plastic cup. The cup was also placed in the water bath for 1 hour. After 1 hour, the two components (i.e., the inhibited catalyst and the resin component) were then combined and mixed rapidly by hand with a spatula until they gelled. The time from when mixing started until the sample gelled was measured and recorded to the nearest 1/10 second. This test was repeated three times and the average gel time for a given amount of NQ is reported in Table II below. In particular, gel time as a function of grams of inhibitor added to the catalyst was as listed in Table II below:

TABLE II

| Grams of NQ | Gel time (s) |
|---|---|
| 0 | 12.0 |
| 0.371 | 20.6 |
| 0.557 | 24.7 |
| 0.753 | 28.1 |
| 1.114 | 38.1 |

As shown in Table II, gel time can be effectively adjusted over a wide range by adding inhibitor to the catalyst. Thus, a wide range of Speed Indexes can be accommodated by making adjustments to the catalyst using inhibitor.

With respect to the gel time testing described above for the results listed in Table II, the term "gel time" as used in this patent is determined according to that test.

Potential fillers for use with the systems as described herein include, but are not limited to, limestone, fly ash, sand, and talc. Additional fillers include calcite, granite, basalt, dolomite, andesite, feldspars, amphiboles, pyroxenes, olivine, iron oxides, gabbro, rhyolite, syenite, diorite, dolerite, peridotite, trachyte, obsidian, quartz, vitrified clay, slag, cinders, fly ash, glass cullet, and fibrous materials such as chopped metal (preferably steel) wire, glass fibers, asbestos, cotton, and polyester and aramid fibers. Potential fillers are listed in U.S. Pat. No. 4,280,943 as described and incorporated by reference elsewhere herein.

Potential gelling and thickening agents for use with the systems as described herein include, but are not limited to, hydroxyethyl cellulose (HEC) as well as methylcellulose and hydroxypropyl methylcellulose available from the Dow Chemical Company, as well as other water-based polymers. Such thickeners have particular use with the catalyst in keeping the filler (e.g., limestone) from settling. In addition, other such agents include carboxymethylcelluloses, polyvinyl alcohols, starches, carboxy vinyl polymers, and other mucilages and resins such as galactomannans (e.g., guar gum), polyacrylamides, and polyethylene oxides. Such potential agents are listed in U.S. Pat. No. 4,280,943 as described and incorporated by reference elsewhere herein.

The number of pumps used during manufacture of the two-speed resin system cartridges is an important consideration. Pumps can be extremely expensive, costing on the order of $100,000 each, and also must be maintained. Further, manufacture is switched between grouting systems having different gel times, the pump systems need to be cleaned. The pumps are not only difficult to clean, but it is difficult to remove all residue from the associated pipes. This results in scrapped/wasted product (e.g., hundreds of pounds of material) that cannot be sold due to undesired formulation, as well as lost manufacturing time. Thus, if the number of pumps required to manufacture the cartridges can be decreased, substantial initial and ongoing cost and time savings can be realized.

In a first exemplary embodiment of a manufacturing operation, three pumps are provided for producing a two-speed resin system cartridge. In particular, two of the pumps are provided for delivering resins of different speeds, in particular a first pump for fast gel time resin and a second pump for slow gel time resin. A third pump is provided for delivering catalyst. For example, a two-speed grouting system cartridge can be manufactured as shown in exemplary FIG. 1. In particular, slow gel resin mastic in tank 1 is pumped by pump 3, catalyst mastic in tank 2 is pumped by pump 4, and fast gel resin mastic in tank 10 is pumped by pump 11. A two compartment mine support cartridge 9 includes a resin compartment 7 and a catalyst compartment 8. Resin mastic from tanks 1, 10 is pumped by pumps 3, 11, respectively, through resin fill tube 5 into compartment 7. Catalyst mastic from tank 2 is pumped by pump 4 through catalyst fill tube 6 into compartment 8. A continuous film is provided for forming cartridge 9 with catalyst mastic being continuously pumped into catalyst compartments 8 of successive cartridges, while pumps 3, 11 are alternately turned on and off to fill each resin compartment in part with a slow gel resin mastic and in part with a fast gel resin mastic.

In a second exemplary embodiment of a manufacturing operation, two pumps are provided for producing a two-speed resin system cartridge. In particular, a first pump is provided for delivering resin while a second pump is provided for delivering catalyst. Promoter may be added, for example, to half (or other amount) of the resin section of the cartridge to obtain the desired two speeds. For example, a two-speed grouting system cartridge can be manufactured as shown in exemplary FIG. 2. In particular, slow gel resin mastic in tank 21 is pumped by pump 23, catalyst mastic in tank 22 is pumped by pump 24, and promoter in tank 32 is pumped by pump 33. A two compartment mine support cartridge 29 includes a resin compartment 27 and a catalyst compartment 28. Resin mastic from tank 21 is pumped by pump 23 through resin fill tube 25 into compartment 27. Catalyst mastic from tank 22 is pumped by pump 24 through catalyst fill tube 26 into compartment 28. A continuous film is provided for forming cartridge 29 with catalyst mastic being continuously pumped into catalyst compartments 28 of successive cartridges, while pump 33 is alternately turned on and off to add promoter to a portion of the stream of resin mastic from tank 21 so that each resin compartment 27 is filled in part with a slow gel resin mastic (not promoted) and in part with a fast gel resin mastic (promoted).

Figure 2:
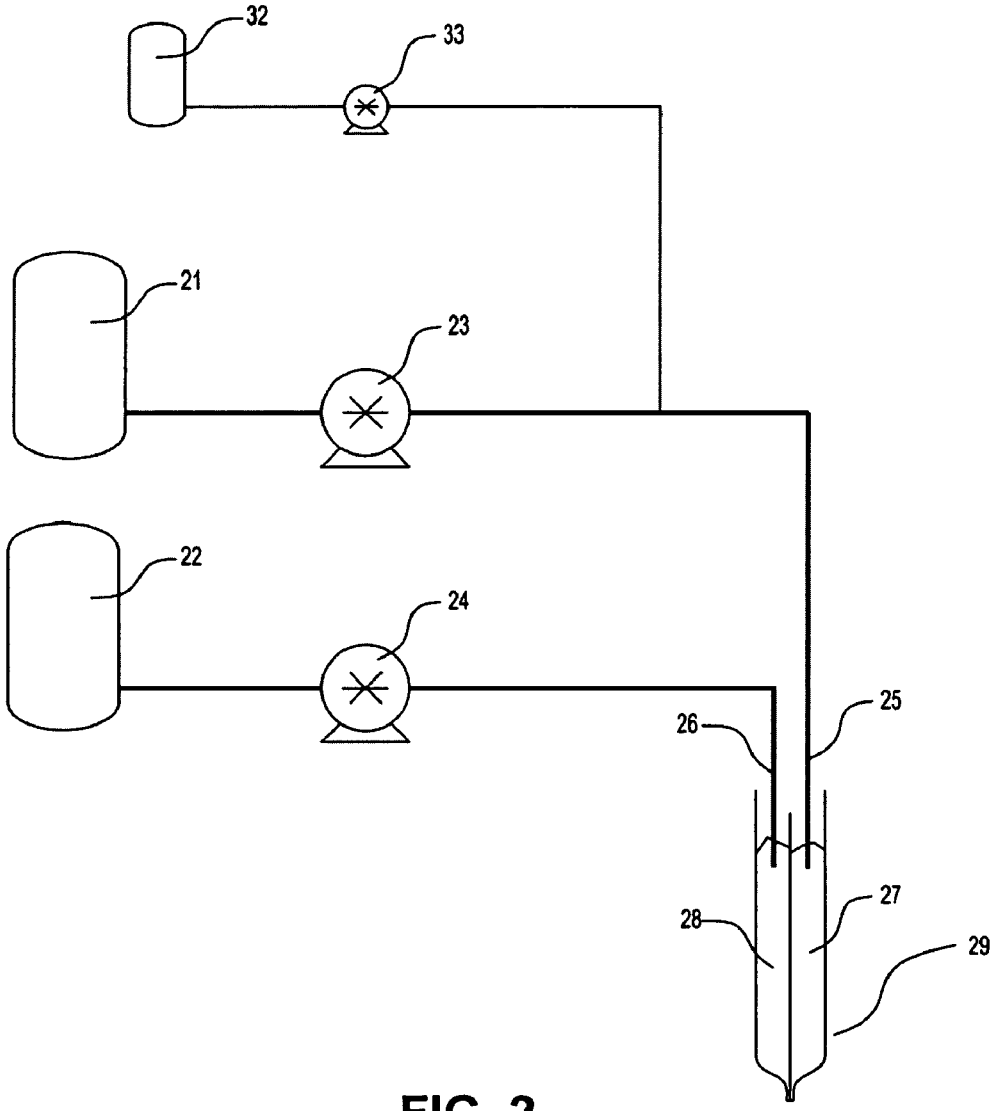
FIG. 2 shows another exemplary embodiment of a cartridge manufacturing operation.

In a third exemplary embodiment of a manufacturing operation, two pumps are provided for producing a two-speed resin system cartridge. In particular, a first pump is provided for delivering resin while a second pump is provided for delivering catalyst. Inhibitor may be added, for example, to half (or other amount) of the resin section of the cartridge to obtain the desired two speeds. The exemplary embodiment shown in FIG. 2 is applicable to this third exemplary embodiment except that instead inhibitor in tank 32 is pumped by pump 33, with pump 33 being alternately turned on and off to add inhibitor to a portion of the stream of resin mastic from tank 21 so that each resin compartment 27 is filled in part with a slow gel resin mastic (inhibited) and in part with a fast gel resin mastic (not inhibited).

In a fourth exemplary embodiment of a manufacturing operation, two pumps are provided for producing a two-speed resin system cartridge. In particular, a first pump delivers resin, while a second pump delivers catalyst. Inhibitor is injected into the catalyst, for example to half (or other amount) of the catalyst section of the cartridge to obtain the desired two speeds (dual speed). This embodiment is easier to color with a dye because the dye is included with the catalyst and advantageously makes the catalyst more stable. It also is desirable to add dye and inhibitor together because then a user would have an absolute visual indicator that the inhibitor has been added to the catalyst (e.g., it is advantageous to dye the chemical such as the inhibitor that is being injected). For example, a two-speed grouting system cartridge can be manufactured as shown in exemplary FIG. 3. In particular, slow gel resin mastic in tank 41 is pumped by pump 43, catalyst mastic in tank 42 is pumped by pump 44, and inhibitor in tank 54 is pumped by pump 55. A two compartment mine support cartridge 49 includes a resin compartment 47 and a catalyst compartment 48. Resin mastic from tank 41 is pumped by pump 43 through resin fill tube 45 into compartment 47. Catalyst mastic from tank 42 is pumped by pump 44 through catalyst fill tube 46 into compartment 48. A continuous film is provided for forming cartridge 49 with catalyst mastic being continuously pumped into catalyst compartments 48 of successive cartridges, while pump 55 is alternately turned on and off to add inhibitor to a portion of the stream of catalyst mastic from tank 42 so that a portion of each catalyst compartment 48 is filled with catalyst with inhibitor and a portion is filled with catalyst without inhibitor.

Figure 4:
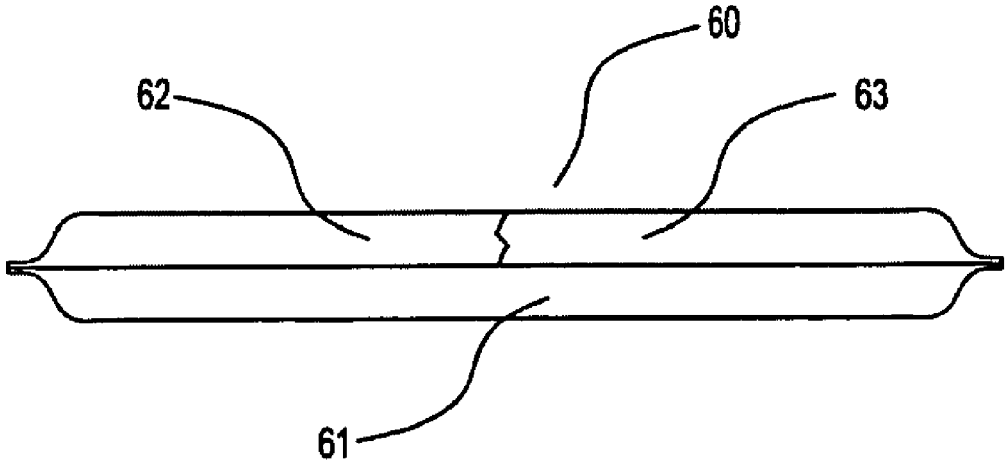
FIG. 4 shows an exemplary embodiment of a two-speed grouting system cartridge.

With the fourth embodiment, for example, grout cartridges 60 can be formed by timing the clipping head to form the package so that a cartridge has a first catalyst section 62 that is provided with inhibitor and a second catalyst section 64 that is not provided with inhibitor, as well as a resin section 61, thus providing a grouting cartridge that has two speeds. This is shown in FIG. 4.

Figure 3:
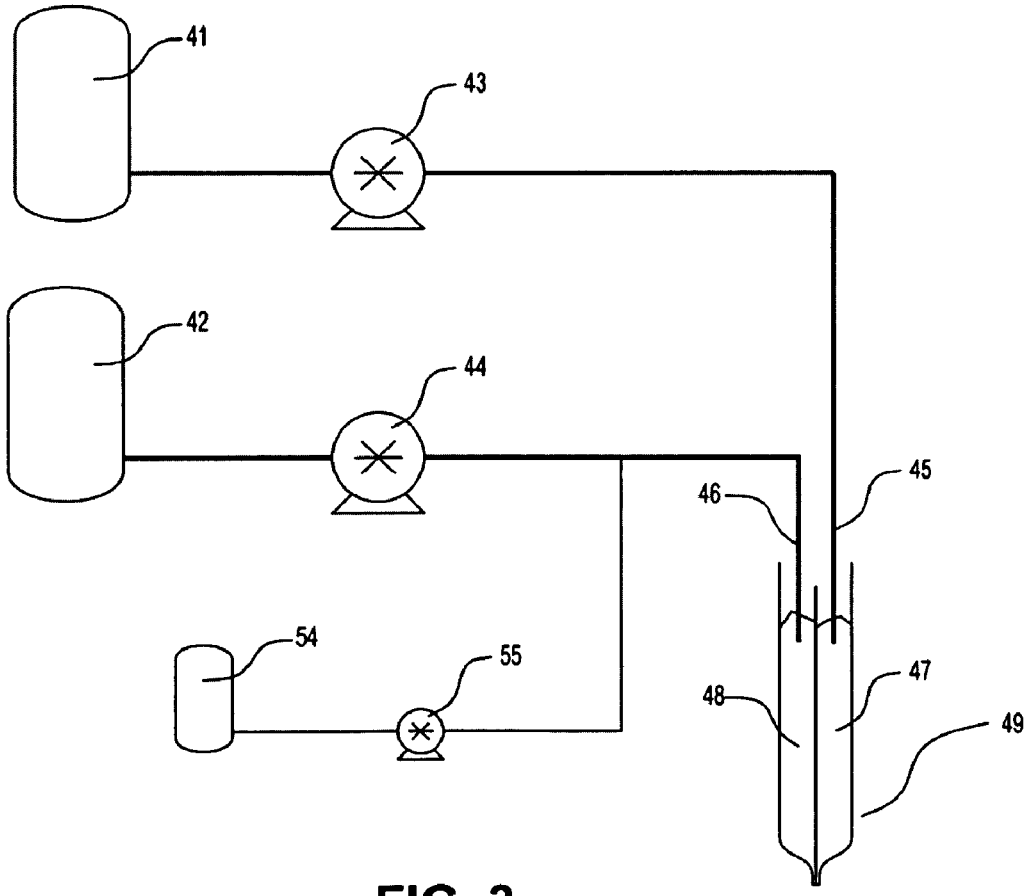
FIG. 3 shows yet another exemplary embodiment of a cartridge manufacturing operation.

In a fifth exemplary embodiment of a manufacturing operation, two pumps are provided for producing a two-speed resin system cartridge. In particular, a first pump delivers resin, while a second pump delivers catalyst. Inhibitor is injected into the catalyst, for example to half (or other amount) of the catalyst section of the cartridge to obtain the desired two speeds (dual speed). A different colorant is injected into the inhibited portion of the catalyst section as compared to the non-inhibited portion of the catalyst section (i.e., two colorants are used with the catalyst). The exemplary embodiment shown in FIG. 3 is applicable to this fifth exemplary embodiment except that instead a colorant is injected with inhibitor to a portion of the stream of catalyst from tank 42 so that a portion of each catalyst compartment 48 is filled with catalyst with inhibitor and colorant and a portion is filled with catalyst without inhibitor and colorant.

In a sixth exemplary embodiment of a manufacturing operation, two pumps are provided for producing a one-speed resin system cartridge. In particular, a first pump delivers resin, while a second pump delivers catalyst. Inhibitor is injected into the catalyst. The advantage of this embodiment is that in situ gel time adjustment is permitted by adding inhibitor to the catalyst at the cartridge packaging machine, rather that in the bulk tanks which have compositions with particular gel times. Such an embodiment also can be realized as for example shown in FIG. 3.

In a seventh exemplary embodiment of a manufacturing operation, a three or more speed resin system can be produced. Such an embodiment also can be realized as for example shown in FIG. 3, by adjusting the speed of pump 55 in discrete steps, e.g., to provide a fast speed, medium speed, and slow speed.

In an eighth exemplary embodiment of a manufacturing operation, yet another three or more speed resin system can be produced. Such an embodiment also can be realized as for example shown in FIG. 3, by adjusting the speed of pump 55 continuously while filling the cartridge, e.g., to provide a speed change by gradient over the length of the cartridge. For example, the cartridge may have a 10 second speed at one end that gradually changes to a 60 second speed at the other end.

In a ninth exemplary embodiment, the speed of the resin can be adjusted to be multi-speed and the speed of the catalyst can be adjusted to be multi-speed, such as by injecting promoter or inhibiter into the resin that fills the resin compartment and by injecting promoter or inhibiter into the catalyst that fills the catalyst compartment. This speed adjustment may be done in discrete steps or continuously.

When colorant is injected for example into catalyst, the colorant for one portion may be yellow and for a second portion additional colorant or different colorant may be injected. Different colorants may be blended, for example, with yellow being injected for one portion and additional blue injected for another portion to together provide the color green. Alternatively, one section may have the colorant yellow and the other black.

In addition, it is important to be able to recognize which end of the two-speed grouting capsule provides a "faster gel time" and which end provides a "slower gel time." While the film package that forms the cartridge can be color-coded at each end, there is a risk that during manufacturing the wrong film color can be assigned to a particular gel time. The danger is that in the field, a user may have been trained to always insert a cartridge into a borehole with a particular colored end first, but during manufacture the wrong "speed" was associated with that end. As a result, sometimes catalyst is dyed (e.g., red catalyst represents 10 second gel time while green catalyst represents 30 second gel time). However, it can be difficult to dye catalyst because peroxides tend to be bleaches. Yet advantageously, a catalyst is more stable if inhibitor is added to it and furthermore the dye color may remain more stable as a result. Moreover, the catalyst portion of the grouting typically is generally white in color due to the white limestone often used as a filler (as well as the natural color of the BPO, thus making it relatively easy to add a colorant to the catalyst because the initial color of the catalyst without the colorant is white. A substantial amount of filler (e.g., 80-85% may be incorporated with each of the resin and catalyst), thus having a significant impact on color. This is in contrast to the resin portion of the grouting which typically is darker due to the natural coloration of the resin and the natural color of the limestone used as a filler. White limestone is more expensive than gray limestone, so the white variety typically is used with the smaller amount of catalyst needed while gray limestone is used with the larger amount of resin needed. It therefore is harder to effectively color the resin so that a consumer can distinguish between fast and slow speeds.

An exemplary procedure for using the two-speed resin systems described herein for anchoring mine bolts and tendons to provide roof and side wall support in mines is: (1) a borehole is drilled to a desired diameter (to provide a desired annulus) and length as specified by a manufacturer of a given reinforcement (e.g., a bolt or tendon); (2) inserting into the borehole the reinforcement as well as the resin system capsule with the "faster" end inserted first so that the capsule extends to the top of the hole, (3) spinning the reinforcement to shred the capsule and mix the contents thereof; (4) holding the bolt stationary to allow the gel time of the faster end to elapse and the faster end to set; (5) pretensioning the reinforcement after the "faster" end sets but before the "slower" end sets to provide desired tensioning; (6) allowing the "slower" end to set to create a desired prestress load.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A method of adjusting gel time of a grouting system used for anchoring a reinforcement in a mine comprising:

adding inhibitor to initiator of the grouting system, the inhibitor and initiator being disposed together in a first compartment of a multi-compartment shreddable package.

2. The method of claim 1, wherein the initiator is catalyst mastic.

3. The method of claim 1, wherein the initiator is a free radical generating component.

4. The method of claim 3, wherein the initiator comprises benzoyl peroxide.

5. The method of claim 1, wherein the inhibitor is a free radical inhibitor.

6. The method of claim 5, wherein the inhibitor is selected from the group consisting of naphthoquinone and hydroquinone.

7. The method of claim 1, wherein the grouting system further comprises resin mastic in a second compartment of the multi-compartment shreddable package.

8. The method of claim 7, wherein the resin mastic comprises polyester with a styrene monomer cross-linking agent.

9. A method of adjusting gel time of a resin-catalyst system used for anchoring a reinforcement in a mine comprising:

adding inhibitor to catalyst separated from resin in the system.

10. A method of anchoring a reinforcement in a mine comprising:

providing a borehole;

inserting a capsule in the borehole, the capsule having (1) a first section with resin mastic therein and (2) a second section with catalyst mastic and an inhibitor therein, wherein the inhibitor is substantially disposed in only a portion of the catalyst mastic in the second section;

inserting a reinforcement in the borehole;

spinning the reinforcement to puncture the capsule and mix the resin mastic, catalyst mastic, and inhibitor;

holding the reinforcement stationary for a first period of time.

11. The method of claim 10, wherein the capsule is inserted in the borehole so that an end of the capsule abuts a closed end of the borehole.

12. The method of claim 10, wherein the capsule and reinforcement are inserted into the borehole at the same time.

13. The method of claim 10, further comprising:

tensioning the reinforcement after the first period of time.

14. A grouting system for anchoring a reinforcement in a mine comprising:

a package comprising a tubular member formed of polymer film and having discrete first and second compartments;

a resin mastic disposed in the first compartment;

a catalyst mastic and an inhibitor disposed in the second compartment.

15. The grouting system of claim 14, wherein the catalyst mastic comprises benzoyl peroxide.

16. The grouting system of claim 14, wherein the inhibitor comprises naphthoquinone.

17. The grouting system of claim 14, further comprising a colorant in the first compartment.

18. The grouting system of claim 14, wherein the colorant is a dye.

19. The grouting system of claim 14, wherein the resin mastic comprises polyester with a styrene monomer cross-linking agent.

20. The system of claim 14, wherein the resin mastic comprises methyl methacrylate.

21. The system of claim 14, wherein the second compartment comprises a first portion in which both catalyst mastic and inhibitor are disposed and a second portion in which catalyst mastic is disposed substantially without inhibitor.

22. The system of claim 14, wherein at least one of the catalyst mastic and resin mastic comprises limestone.

23. A method of achieving substantially uniform setting of a resin-catalyst system used for anchoring a reinforcement in a mine, the method comprising:

adding inhibitor to catalyst separated from resin in the resin-catalyst system such that gel time of the system is independent of resin to catalyst ratio, wherein the resin to catalyst ratio is from about 1:1 to about 9:1.

24. The method of claim 23, wherein the resin to catalyst ratio is from about 1.5:1 to about 4:1.

25. The method of claim 24, wherein the catalyst comprises benzoyl peroxide.

26. The method of claim 24, wherein the inhibitor comprises naphthoquinone.

* * * * *